US009353479B2

(12) United States Patent
Baluha

(10) Patent No.: US 9,353,479 B2
(45) Date of Patent: May 31, 2016

(54) CONVEYOR PRODUCT CONTAINMENT DEVICE

(71) Applicant: Mark Regan Baluha, Saginaw, MI (US)

(72) Inventor: Mark Regan Baluha, Saginaw, MI (US)

( * ) Notice: Subject to any disclaimer, the term of this patent is extended or adjusted under 35 U.S.C. 154(b) by 554 days.

(21) Appl. No.: 13/875,971

(22) Filed: May 2, 2013

(65) Prior Publication Data

US 2014/0328635 A1 Nov. 6, 2014

(51) Int. Cl.
*D21F 1/56* (2006.01)

(52) U.S. Cl.
CPC ..... *D21F 1/56* (2013.01)

(58) Field of Classification Search
CPC ..... D21F 1/56; D21F 1/523; D21F 1/58; D21G 9/00; B65G 53/52
See application file for complete search history.

(56) References Cited

U.S. PATENT DOCUMENTS

| | | | | | |
|---|---|---|---|---|---|
| 3,607,624 | A | | 9/1971 | Moody et al. | |
| 3,839,148 | A | * | 10/1974 | Beck | D21G 9/00 162/275 |
| 4,081,321 | A | * | 3/1978 | Wolf | D21F 1/02 162/346 |
| 4,124,441 | A | | 11/1978 | Nykopp | |
| 4,315,799 | A | * | 2/1982 | Turek | D21F 1/523 162/352 |
| 4,738,751 | A | | 4/1988 | Newcombe | |
| 4,968,387 | A | | 11/1990 | Beran et al. | |
| 5,045,154 | A | * | 9/1991 | Baluha | D21F 1/56 162/272 |
| 5,284,551 | A | | 2/1994 | Beran et al. | |
| 5,296,101 | A | | 3/1994 | Peterson | |
| 6,146,502 | A | | 11/2000 | Marx | |
| 7,494,570 | B2 | | 2/2009 | Laari | |
| 8,236,139 | B1 | | 8/2012 | Reed | |
| 2008/0236775 | A1 | * | 10/2008 | Laari | D21F 1/56 162/202 |
| 2014/0328635 | A1 | * | 11/2014 | Baluha | D21F 1/56 406/122 |
| 2015/0225897 | A1 | * | 8/2015 | Forester | D21F 1/56 162/310 |

FOREIGN PATENT DOCUMENTS

| | | | | |
|---|---|---|---|---|
| FI | EP 1975312 | A1 * | 10/2008 | D21F 1/56 |

* cited by examiner

*Primary Examiner* — Jose Fortuna
(74) *Attorney, Agent, or Firm* — Reising Ethington PC

(57) ABSTRACT

An improved conveyor product containment device comprised of a main body having a top, a bottom and two elongate sides and an independent and changeable variable height front seal face having a top, a bottom and two elongate sides. The main body and the independent and changeable front seal face are secured using conventional means and in a relation that creates a open seal area below the main body. The main body has a multitude of recessed seal water nozzles that deliver the seal water to the bottom inside lower edge of the independent and changeable front seal face or the top of the conveyor. An embodiment has a tee channel and attached support tube opposite the recessed nozzles and front seal face.

9 Claims, 4 Drawing Sheets

CONVEYOR PRODUCT CONTAINMENT DEVICE

FIELD OF THE INVENTION

This invention relates to the design and application of an improved conveyor product containment device and more specifically to design improvements of the device to contain stock slurry and transition said slurry onto a moving conveyor with particular use on paper making machines.

BACKGROUND

A wide range of devices for conveyor edge product containment and control are known, although typically, these devices generally use mechanical means and contact with the conveyor to prevent side discharge of the product off of the conveyor edge. On a typical papermaking machine, the paper pulp slurry is delivered onto a conveyor from an extruder or what is commonly known as a headbox. As the paper pulp slurry is extruded onto the continuous conveyor it contains a large amount of liquid, mainly water that will be gradually removed via drainage or dewatering elements positioned under the screen conveyor. The paper pulp slurry's high water content and/or combined basis weight at the extruder or headbox is typically difficult to deliver from the headbox to the conveyor and prevent side discharge and maintain slurry profile as the product tends to expand and spread as it is extruded onto the conveyor.

There are two basic types of conveyor containment devices that have been utilized alongside the edge of the conveyor to prevent the slurry from running off the edge of the conveyor as the liquids are removed from the paper pulp slurry and becoming dry enough to not need further containment and allow the product to be transferred further down the machine and ultimately lifted off of the continuous conveyor.

The first type of containment devices utilize mechanical means of physically lifting the edge, or curling, the conveyor, while the second method of containment is to use an apparatus placed over the top of the conveyor in an attempt to dam the slurry from premature spread or leaking off the conveyor. Most examples of this prior art make contact with or is set so close to the top surface of the conveyor as to be in contact or virtually contacting and uses an elastomeric or mechanical seal, typically rubber. The inherent problems associated with both types of devices are numerous.

The paper pulp slurry conveyor is typically constructed of monofilament or plastic fibers which are very flexible but also quite vulnerable to damage and/or wear, Newcombe U.S. Pat. No. 4,738,751, Beran et al. U.S. Pat. No. 4,968,387 and Peterson U.S. Pat. No. 5,296,101 show us typical edge lifting devices that make contact with the bottom of the conveyor and curl the edge of said conveyor to stop the pulp slurry from leaving the edge of the conveyor. This is a simple method of stopping the flow from leaving the conveyor and has been used since the introduction of modern paper making machines. The associated problems experienced by users of this method are conveyor wear due to lifting the edge, damage to the edge curler or lifting device or conveyor when the conveyor travels horizontally to one side of the machine or the other, and most importantly, waves and disruption created as the pulp slurry spreads and makes initial contact with the lifted edge of the conveyor that cannot be positioned or placed in a proximity close enough to the headbox or extruder because of the curl or lifting of the edge of the conveyor itself. As the pressurized paper pulp slurry of the modern paper and pulp machine is delivered to the conveyor it expands and/or spreads to be ultimately bounced or reflected off the lifted edge of said conveyor.

Beran et al. U.S. Pat. No. 4,968,387 and Peterson U.S. Pat. No. 5,296,101 show an edge curling device used in conjunction with an elastomeric or rubber seal deckling device positioned over the wire or conveyor. Said devices utilize the edge curler as the means to stop the pulp slurry from premature spread and leaving the conveyor and the addition of the elastomeric deckling device over the conveyor attempts to mitigate the associated waves and disruption to the paper slurry caused by the edge lifter. In actuality the elastomeric deckling device in conjunction with the edge curler is difficult to adjust and easily creates a pinch point of the conveyor, creating an additional wear point on the conveyor. Also, the elastomeric device intends the operator to allow an amount of the pulp slurry past and onto the lifted conveyor edge which effectively creates a separation of the slurry changing not only the fiber orientation but adversely affecting the overall formation of the paper product when compared to the area of the sheet adjacent to the device and edge lifter as well as agitating or irritating the fiber slurry and not allowing it to set as it moves along the lifters length.

As one knowledgeable to the prior art can easily determine, containment devices which lift the edge of the conveyor, as shown by Newcombe U.S. Pat. No. 4,738,751, Beran et al. U.S. Pat. No. 5,284,551, Peterson U.S. Pat. No. 5,296,101 and Reed U.S. Pat. No. 8,236,139 B1 apply constant pressure and wear on the bottom surface edge of the conveyor as they attempt to prevent slurry discharge off the side by curling or lifting the side of the conveyor up. These conveyor edge lifting devices cannot be used in close proximity to the extruder or headbox area because of the need to be positioned under the conveyor and this gap or transition result in reflective waves in the paper pulp slurry, affecting product fiber orientation, side leakage and poor product edge formation.

Reed U.S. Pat. No. 8,236,139 shows us a design modification to the edge lifter where the device proposes to dewater the paper slurry as it rides along the apparatus. This may address the dryness of the paper slurry but does nothing about the profile control of said paper product and in all likelihood the attendant dewatering zones in the edge lifter will create additional sheet edge turbulence and reflective waves as well as wet streaks in the pulp slurry at the area at the bottom edge of the lifting device under the conveyor before the dewatering zones begin. Reeds device inherently increases wear on the conveyor edge because of the vacuum created as the conveyor moves across the inventors proposed dewatering areas.

Moody et al. U.S. Pat. No. 3,607,624 shows us an embodiment of a typical elastomeric deckling device using an elastomeric seal strip at its bottom edge, the referred device's proximity to and inherently close contact with the conveyor must be fashioned of softer, more wear prone, material than the conveyor itself. Thus the seal wears and changes characteristics while in operation, making their use troublesome and requiring constant adjustment for exhibited wear which ultimately results in the paper pulp slurry leaking out the sides, damage to the conveyor and/or turbulence created by the uneven wear of the seal. Moody et al and other embodiments of this type of device typically use a metal, rigid main body suspended over the wire or conveyor with an unlike elastomeric or rubber strip fixed to the bottom edge of the metal device body. While being, as exhibited in most prior art, heavy, cumbersome and hard to adjust, the unlike seal material expands and contracts with thermal activity and makes the device that much harder to control or adjust as the machine heats or cools.

The elastomeric seal inherently must be set within very close tolerance, effectively in contact with the conveyor, resulting in subsequent wear of the conveyor surface as the conveyor is in constant directional motion and the under conveyor dewatering devices or elements create uneven pressure points or pulsing that also contributes to the wear of the critical set point of said elastomeric seal, typically soft rubber or vinyl.

These associated devices with their contact or mechanical sealing apparatus exhibit many of the same problems such as side leakage, excessive wear of seal and conveyor, poor product edge formation, and reflective waves into the slurry. Ultimately the edge lifting devices, because they must be placed a distance from the headbox downstream allow the paper slurry to spread and then bounce or reflect back into the slurry with a wave or disturbance. Even when a deckling device placed upstream of the edge lifter, no matter the distance downstream along the conveyor, at the transition point from deckling device to curler, a resulting wave or sheet edge disturbance is experienced.

Baluha U.S. Pat. No. 5,045,154 proposes a device where fluid is delivered to an area behind a front sealing lip and contained between a front sealing edge and a back containment edge embodied in a vertically oriented body. The device's design, when adequate water seal is not maintained, allows excess paper slurry to enter into the area between the front and back containment edges and potentially dam or plug this slot or area. The nozzles integrated inside the area between the front and back containment edges protrude down inside the slot area and when said slurry is allowed to enter this area it coagulates or builds up on the protruding nozzles, increasing the likelihood of plugging the slot area. Once the slot area builds up or plugs the user has no recourse for cleaning this area except to remove the device from the machine, which in all likelihood will result in stoppage of said machine and loss of production. Also the front sealing face of this design is incorporated into the overall design and if damaged or worn the entire device must be replaced. The vertical orientation of the unit makes the apparatus susceptible to horizontal pressures and the verticality of the devices elastomeric components when subjected to temperature changes and lack of integrated horizontal structure or design tends towards longitudinal bowing which can contribute to waves or disruption in the sheet edge product.

Laari U.S. Pat. No. 7,494,570 B2 shows us a device incorporating not one but two slot areas prone to stock accumulation and plugging. Baluha U.S. Pat. No. 5,045,154 and Laari U.S. Pat. No. 7,494,570 present devices that include the seal lips or faces into the unit design and do not have means for change without modifying or changing the overall apparatus.

The present disclosure generally pertains to the improved design and application of an improved conveyor product containment device wherein the front seal face is independent of the main body of the device, where the water delivery manifold is vertically adjustable to minimize water use and maximize the low pressure cohesive, non-contacting seal between the bottom edge of the front seal face and the conveyor. The vertical adjustability of the water manifold in relation to the front seal lip that incorporates a wider flat width at the bottom edge to maximize fluid cohesion with the seal lip reduces the amount of fluid required to maintain a positive, non-wearing seal with the conveyor and increases the gap between the bottom edge of the front seal and the top of the conveyor.

The present disclosure also generally pertains to a proposed improved conveyor product containment device wherein the independent front seal face can be aligned vertically to a height appropriate for a specific product basis weight, thickness or machine condition and can be easily changed if damaged or worn independently of the main device body. The device fluid manifold can be precisely positioned vertically in relation to the independent front seal face so that the delivery of the water or device seal fluid through recessed nozzles aligned in the main body is in the optimal position for the product pulp slurry being manufactured. The device has an open lower backside so that the user can observe the fluid delivery, associated fluid seal, and also more easily check and maintain the generous gap between the front seal face and the conveyor surface. The recessed nozzles and open lower back area prevents excess or escaping pulp slurry from accumulating and provides easier access to this area for maintenance and cleaning.

The improved conveyor product containment device may be constructed of high operating temperature polyethylene or other similar elastomeric materials that resist thermal breakdown and expansion and are more suitable to today's modern, faster and higher temperature paper making machines. A proposed device that incorporates complementary dimensionally shaped components aligned in the design that gives greater balance of internal and external forces and utilizes like-size components to further enhance the device's overall dimensional and thermal stability and better resist horizontal, vertical and longitudinal forces.

A proposed improved conveyor product containment device where there is provided an elongate dimensionally stable device acting as an improved conveyor product containment device comprising an elongate rectangular main body having a top, bottom, two short elongate sides and two short ends. The device further comprises an independent front seal face that is conventionally attached to one short elongate side of the main body. Stainless steel screws or other suitable fasteners may be used. The front seal face may be vertically secured to the main body at a variably fixed height in relation to the vertically adjustable water manifold with recessed overlapping nozzles that reduce the likelihood of stock slurry from accumulating or hanging up on while they create an improved non-contacting water seal at the lower flat bottom portion of the front seal face. The front seal face can be of a variable height required for specific product thickness or basis weight, normally in direct relation to the extruder's maximum extrusion opening or product activity. The main body is typically comprised of two separate parts, a horizontally oriented top and bottom that are fastened together with stainless steel screws, but any suitable fastener may be used. The independent water manifold is located in a machined area normally centered and along the length in the bottom horizontal main body component along with an associated o-ring groove and seal positioned between the top that creates the horizontally oriented manifold seal plate. An opening or inlet in the manifold top supplies water to overlapping nozzles that are positioned along the length of the independent main body water manifold, another opening in the top is used to locate a gauge to indicate the internal fluid pressure and approximate flow to the recessed nozzles. The horizontally oriented main body is then secured to the independent vertically oriented front seal face to create an overall more stable component, more resistant to dimensional forces. The improved device design uses the vertical front seal face orientation opposite the horizontal orientation of the main body in complementary shapes and sizes to create a more dimensionally stable unit that better resists machine loads and thermal expansion and contraction of the device. The horizontal main body can be fixed to the vertical front seal face at a variable horizontal height, delivering the fluid to a variable area behind the independent front seal face as the user deems appropriate.

In a preferred embodiment, the device incorporates a stainless steel tee channel that is fixed typically with stainless steel truss head screws to the back short bottom side of the elongate main body opposite the front seal face to further increase the proposed device's overall dimensional stability and allow easy attachment of mounting hardware that will allow the vertical and horizontal positioning of the device on the paper making machine in relation to the headbox slice area or extruder opening. A stainless steel square support tube usually of similar length as the main body and tee channel, is then secured to the stainless steel tee channel using tee bolts equally spaced along the tube length to further increase the overall unit stability and allowing the attachment of mounting hardware to a short collar of square tubing that slides over the outer dimension of the elongate square support tube. A short round pin is attached parallel to the collar so that vertically and horizontally adjustable mounting hardware can easily be attached to the device by sliding a corresponding round sleeve extender over the pin and securing the two pieces normally with a spring loaded locking pin or similar method. This allows the device to be mounted securely and yet easily removed from the machine for access or maintenance.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

SUMMARY OF THE INVENTION

According to an embodiment, there is provided in a conveyor containment device, a compact low profile device acting as an improved conveyor product containment device. The device comprises an elongate rectangular main body. The main body comprises a top and a bottom. Each of the top and the bottom has two elongate sides and two short sides. The top and the bottom are horizontally articulated and fixed together to create an independent fluid manifold. The device further comprises an elongate first seal face having a top, a bottom and two sides vertically affixed and secured at variable height to a short side of the main body. The front seal face extends below the bottom of the main body to create an open seal area below the main body. The device further comprises a plurality of recessed holes connected to the independent fluid manifold on an elongate side of the main body adjacent to the front seal face. A plurality of nozzles are located in the recessed holes that deliver a directed flow of seal water to a variable area adjacent to an inside lower area at the front seal face or top of the conveyor. The device further comprises a tee channel having a having a length about as long as the length of the device and secured to the side of the main body opposite the front seal face. The device further comprises a support tube having a length about as long as the device and secured to the tee channel. The support tube has attachment collars for the secure and adjustable mounting along the edge of a continuous conveyor.

In an embodiment of an improved conveyor product containment device where the improvement comprises the orientation of the individual device components in complementary shapes and sizes arranged horizontally and vertically to provide a efficient and compact device and an overall more dimensionally stable device better able to resist the thermal and physical forces applied to the device during its service life. The integrated tee channel and incorporated support tube of the proposed device further enhance the structural integrity and provide an adaptable and suitably strong attachment point for the mounting brackets. This improved dimensional stability promotes more accurate orientation or placement in relation to the conveyor surface relating to improved and more reliable conveyor and device operation, the more compact horizontal device orientation provides the user with greater visibility of the conveyor and moves the mounting attachment points of the device away from the conveyor edge promoting safer operator access for device adjustment.

Accordingly an embodiment provides an improved conveyor product containment device with an independent variable height front seal face that is easily detached or changed by conventional means so that the device's performance in relation to the front seal face can be maintained at peak levels as the front seal face wears or is damaged over time, while overall use of seal water can be minimized by accurate positioning of the directed seal water while the variable height relation of the device water manifold to independent front seal face position allows the user to maximize seal water performance and minimizing potential excess seal water impact on the extruded product.

According to an embodiment, an improved conveyor product containment device is provided. The improvement comprises nozzles recessed into the main body which provides an open and clear view of the directed seal water that reduces the chance that escaping stock or slurry will accumulate or plug the seal water area, the open area also allows better access for maintenance, cleaning and additionally promotes more accurate setting or placement of the device in relation to conveyor surface.

Figure 1:
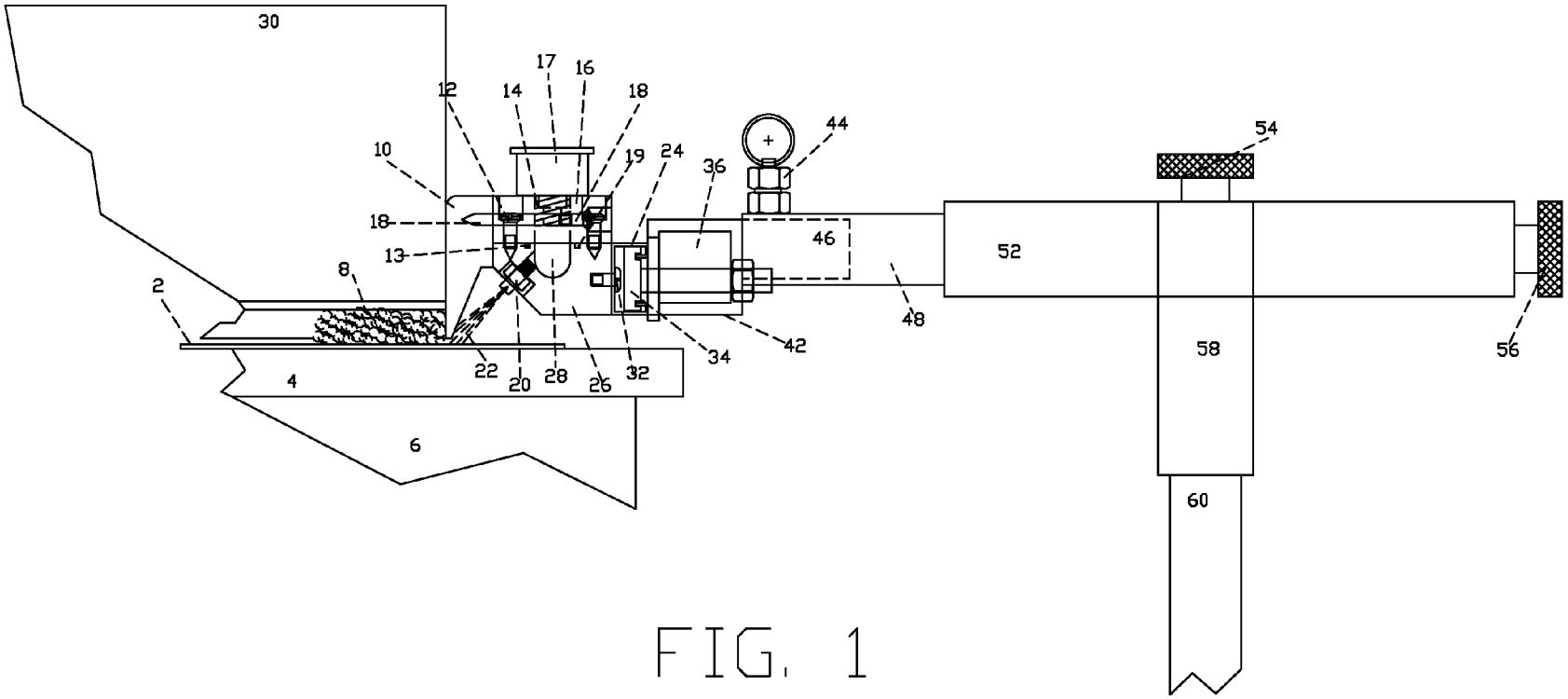
FIG. 1 shows an end view of an embodiment.

Accordingly, other features of the present embodiments may include:

(a) to provide an improved conveyor product containment device wherein the seal area of the device requires no direct contact with the conveyor surface.

(b) to provide an improved conveyor product containment device wherein the device is of a low profile, compact and stable design which is easily handled and adjusted while minimizing risk to the expensive and vulnerable conveyor.

(c) to provide an improved conveyor product containment device which provides an accurate and effective control of the paper pulp slurry regardless of the elements and devices employed below or underneath the conveyor.

(d) to provide an improved conveyor product containment device that provides the operator with an independent replaceable front seal lip that can be of any effective shape or form required.

(e) to provide an improved conveyor product containment device which controls the paper pulp slurry edge and contains any leakage of slurry while controlling excess stock, spray and mist while maximizing the position of the seal water and minimizing the amount of seal water required.

(f) to provide an improved low profile conveyor product containment device where the adjustment positions are well outside the slurry or conveyor area.

Further advantages will become apparent from a consideration of the ensuing description and drawings.

REFERENCE NUMERALS IN DRAWINGS

2 continuous conveyor
4 dewatering element
6 dewatering element box
8 pulp stock or slurry
10 variable height independent front seal face
12 main body screw
13 o-ring seal
14 inlet
16 main body top
17 water pressure gauge
18 front seal face screw
19 o-ring groove
20 nozzle
22 directed seal water
24 tee channel
26 main body bottom
28 water manifold
30 extruder or headbox
32 truss head screw
34 tee bolt
36 support tube
42 collar
44 spring activated locking pin
46 tube pin
48 horizontal bracket extender
52 horizontal adjustment bracket
54 vertical adjustment knob
56 horizontal adjustment knob
58 vertical adjustment bracket
60 vertical bracket extender

DETAILED DESCRIPTION OF THE DRAWINGS

Referring more specifically to the drawings, FIG. 1 illustrates the end profile view of the improved conveyor product containment device. FIG. 1 shows an embodiment of the present invention which is an improved conveyor product containment device referred to hereafter as the "device".

Figure 2:
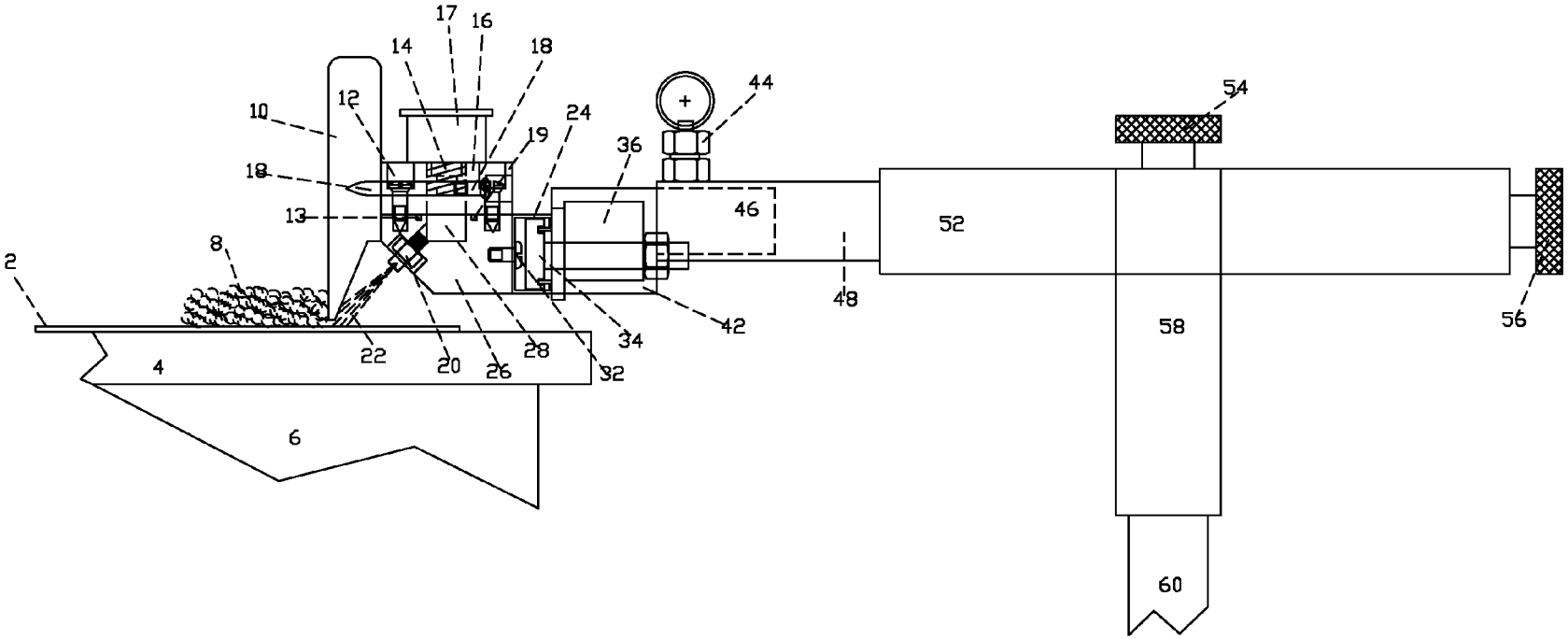
FIG. 2 shows an end view of the improved conveyor product containment device presenting a horizontally taller front seal face generally used for containment of slurry or product activity on heavier basis weight pulp and paper products.

In use, typically, FIG. 1 and FIG. 2, the device has a horizontally oriented two piece elongate main body comprised of an elongate main body top 16 and an elongate main body bottom 26 which may be made of high operating temperature polyethylene or similar material. The top 16 and bottom 26 may be generally horizontally oriented. It will be appreciated that any suitable material may be used. Each of the top 16 and bottom 26 has two relatively short sides and two elongate sides. The two pieces of the main body, the top 16 and bottom 26 are fixed together using main body screws 12 or other suitable fasteners. The main body bottom 26 has one or more machined slots down the center of the top of the elongate side and the slots are surrounded by an o-ring groove 19 where an o-ring seal 13 is seated in the o-ring groove 19, creating an independent water manifold 28.

A threaded inlet 14 is machined through the top elongate side of the main body top 16 for every, one or more, corresponding machined slot in the elongate main body bottom 26 for water or liquid supply. Another inlet is machined through the main body top 16 for every, one or more, corresponding machined slot in the main body bottom 26 for a pressure gauge 17.

A series of through holes are machined across the main body top's 16 width equally spaced along the elongate length to accommodate the front seal face screws 18 which are used to secure the vertically adjustable variable height independent and changeable front seal face 10 to the independent main body.

The variable height independent front seal face 10 has a top, a bottom, one flat vertical side and one angled vertical side connected with respect to the main body. The main body and the front seal face may comprise the same material. The main body and the front seal face may comprise any suitable material. By way of non-limiting example, the main body and the front seal face may comprise metal or elastomeric material or combinations.

A series of overlapping recessed nozzles 20 are located on a short angled side adjacent to the variable height independent front seal face 10 and the main body top 16 and bottom 26. A tee channel 24 is fixed to the lower bottom edge of the main body bottom 26 with truss head screws 32 or suitable similar fastener. The tee channel 24 allows convenient attachment of the support tube 36 with the tee bolts 34 while providing increased dimensional stability and machine direction or longitudinal attachment of the mounting hardware via collars 42 with the attached tube pin 46 that connects into the horizontal bracket extender 48 and is secured in place by a spring activated locking pin 44 or any other suitable fastener. The tee channel 24 may have a length about as long as the device and is secured to the side of the main body opposite the variable independent front seal face 10.

The support tube 36 may have a length about as long or longer than the device. The support tube 36 is secured to the tee channel 24 with tee bolts 34 and attachment collars 42 are located along the length of the support tube 36 to allow for the secure and adjustable mounting of the support tube 36 and attached device along the edge a continuous conveyor.

FIG. 2 shows the embodiment of the device's variable height independent front seal face 10 secured to a short side of the main body in a like height as FIG. 1 with the front seal face screws 18 and with the independent front seal face 10 of a taller height.

Figure 3:
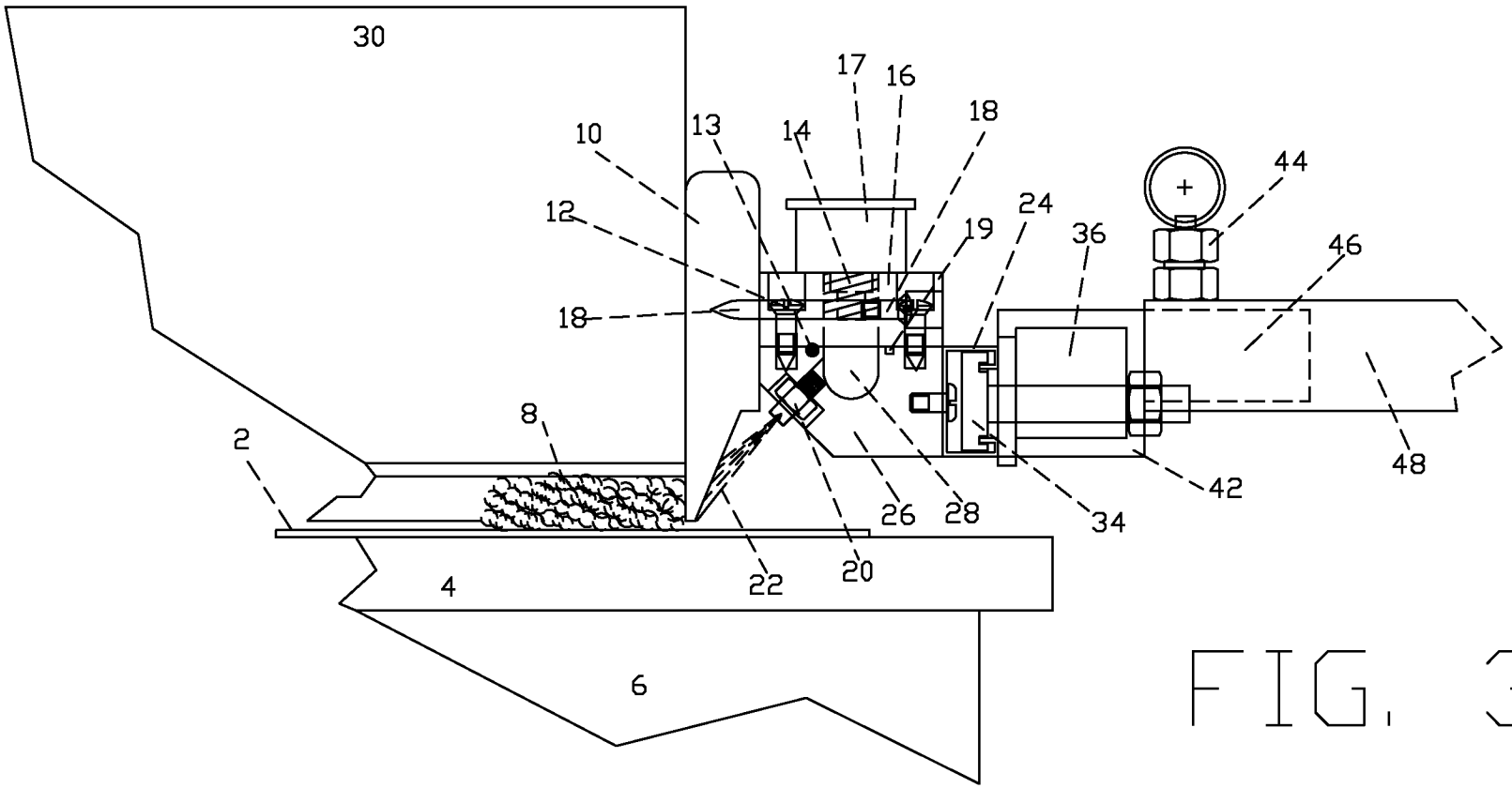
FIG. 3 presents an end view of the improved conveyor product containment device presenting a horizontally taller front seal face where the main body is attached vertically higher on the front inside face directly impacting the fluid delivery area moving it higher up the lower portion of the back side of the front seal face.

FIG. 3 shows the front seal face 10 and the variable height positioning of the main body top 16 and bottom 26 and independent water manifold 28 and how the vertical relationship of the components can vary simply by unscrewing the front seal face screw 18, moving the front seal face 10 vertically up or down in relation to the main body and water manifold 28 creating an open seal area below the main body and screwing the front seal face screw 18 into the desired position. FIG. 3 shows the placement and height variation in directed seal water 22 delivered through the recessed nozzle 20 and the possible vertical relationship change between the main body and the front seal face 10.

Figures 4, 5:
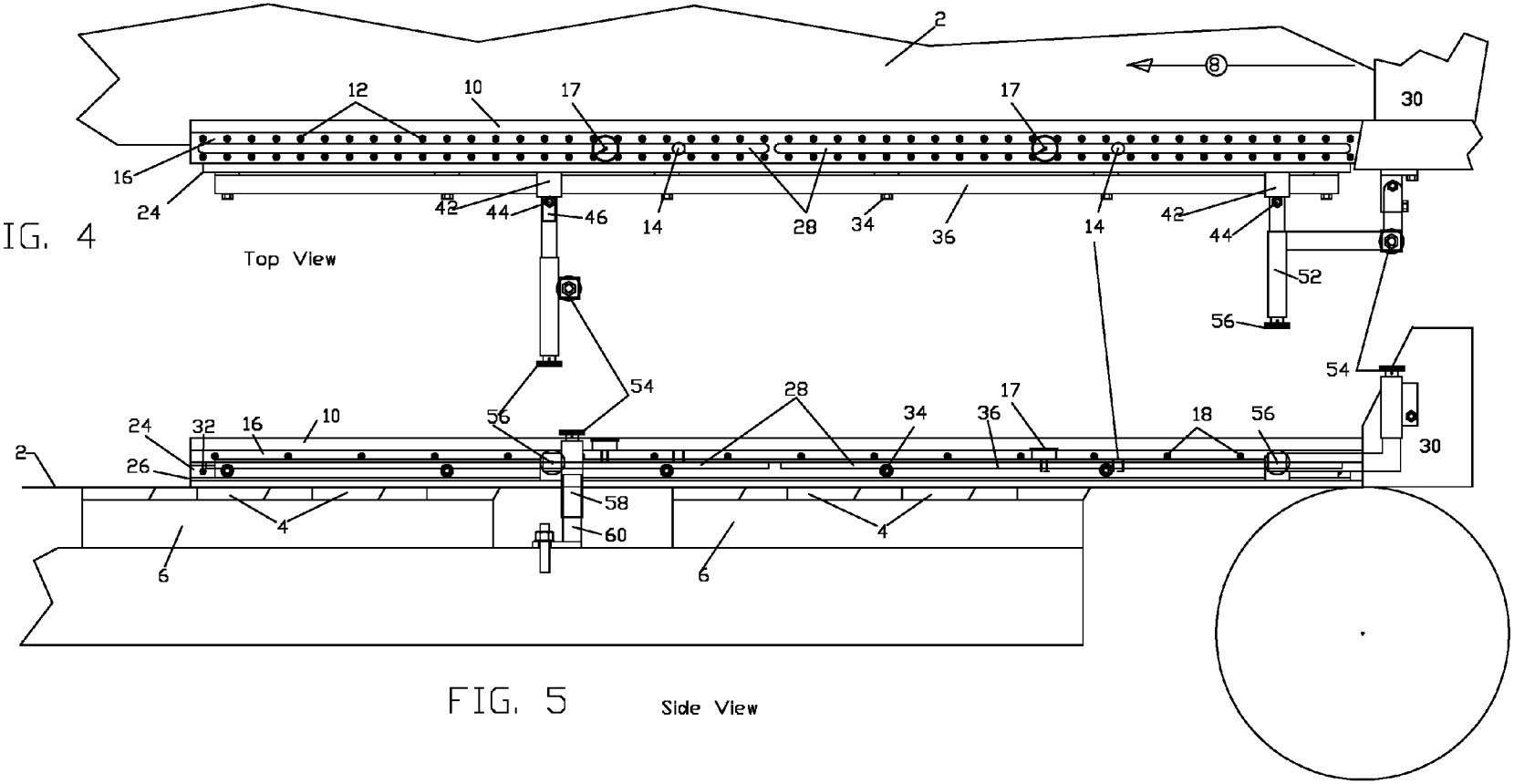
FIG. 4 shows a top view of an embodiment of the device.
FIG. 5 shows a side view of an embodiment of the device.

FIG. 4 and FIG. 5 refer to the top and side views of an embodiment of the device and the shown assembly of the main body bottom 26 and main body top 16 with the multitude of main body screws 12 fixing the two main body parts together to create the independent water manifold 28 and the complementary horizontal placement of the main body in relation to the vertical orientation of the front seal face 10 FIG. 4 and FIG. 5 show the elongate relation of the tee channel 24 to the elongate support tube 36 fixed securely to the tee channel 24 with the tee bolts 34 and also show the collars 42 and how those are longitudinally positional on the support tube 36, the device's height above or gap over the continuous conveyor 2 and the presence and likely location of the dewatering element box 6 and the associated dewatering elements 4.

Accordingly, an embodiment of the present invention comprises an improved conveyor product containment device for use in containing the spread of pulp slurry as it is extruded onto a continuous moving conveyor and transitioning said slurry onto and down the conveyor with no conveyor contact and minimal disruption of the slurry until it is stable enough to be continued down the length of the conveyor without guidance. An improved conveyor product containment device providing an independent, easily changeable, and variable height front seal face with a height positional independently of the main body and water manifold with nozzles recessed into the main body to eliminate likelihood of the pulp slurry accumulating or plugging the seal area, to promote cleaner operation, an easily observed seal area, all encompassed into a low profile, compact and more dimensionally stable overall design.

An improved conveyor product containment device that is more accurately positioned and requires less operator interface due to the improved dimensional stability and the suitably strong mounting attachment points of the device while the directed seal water conforms to the elements and equipment under the conveyor. The devices more accurate positioning provides the user with a more generous gap setting between the conveyor and front seal face, reducing the likelihood of wear or damage to the conveyor and the device.

Although the description above contains many specificities, these should not be construed as limiting the scope of the invention but as merely providing illustrations of some of the preferred embodiments of the invention. For example, the front seal face can be of some other type of material or shape than the main body. The water manifold could be a tube or pipe enclosed inside the main body rather than machined and the main body could be a different shape, size or material. Thus the scope of the invention should be determined by the appended claims and the legal equivalents rather than by the examples given.

What is claimed is:

1. In a conveyor containment device for papermaking, a compact low profile device acting as an improved conveyor product containment device comprising:

an elongate rectangular main body comprising a top, and a bottom, each side of the top and the bottom having two elongate sides and two short sides, the top and the bottom are generally horizontally oriented and fixed together to create an separate fluid manifold;

an elongate front seal face having a top, a bottom and two sides vertically oriented and secured at variable height to a short side of the main body the front seal face extending below the bottom of the main body to create an open seal area below the main body;

a plurality of recessed holes connected to the separate fluid manifold in an elongated side of the main body adjacent to the front seal face;

a plurality of nozzles located in the recessed holes that deliver a directed flow of seal water to a variable area adjacent to an inside lower area of the front seal face or top of the conveyor;

a tee channel having a length about as a long as the main body elongate side secured to the side of the main body opposite the front seal face;

a support tube having a length about as long as the main body elongate side secured to the tee channel with tee bolts and having attachment collars for the secure and adjustable mounting along the edge of a continuous conveyor.

2. The conveyor product containment device of claim 1, wherein the front seal face is separate and changeable.

3. The conveyor product containment device of claim 2, wherein the main body and separate and changeable front seal face are made of the same material.

4. The conveyor product containment device of claim 2, wherein the separate and changeable front seal face is made of metal.

5. The conveyor product containment device of claim 2, wherein the separate and changeable front seal face is made of elastomeric material.

6. The conveyor product containment device of claim 1, wherein the seal water nozzles are recessed into the main body.

7. The conveyor product containment device of claim 1, wherein the main body is made of metal.

8. The conveyor product containment device of claim 1, wherein the main body is made of elastomeric material.

9. The conveyor product containment device of claim 1, wherein the main body and front seal face are made of the same material.

* * * * *